US008601686B2

(12) United States Patent
Matsunaga et al.

(10) Patent No.: US 8,601,686 B2
(45) Date of Patent: Dec. 10, 2013

(54) WATER CIRCULATING PUMP, MANUFACTURING METHOD THEREOF, AND HEAT PUMP APPARATUS

(75) Inventors: Noriaki Matsunaga, Tokyo (JP); Hiroki Asou, Tokyo (JP); Mineo Yamamoto, Tokyo (JP); Mamoru Kawakubo, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 360 days.

(21) Appl. No.: 12/899,762

(22) Filed: Oct. 7, 2010

(65) Prior Publication Data

US 2011/0083828 A1 Apr. 14, 2011

(30) Foreign Application Priority Data

Oct. 13, 2009 (JP) ..... 2009-236317

(51) Int. Cl.
*B23P 6/00* (2006.01)

(52) U.S. Cl.
USPC ..... 29/888.02

(58) Field of Classification Search
USPC ..... 29/888.02, 888, 888.021; 417/420
See application file for complete search history.

(56) References Cited

U.S. PATENT DOCUMENTS

| | | | |
|---|---|---|---|
| 2004/0184936 A1 | 9/2004 | Yanagihara et al. | |
| 2007/0237660 A1 | 10/2007 | Akiyoshi | |
| 2008/0038126 A1* | 2/2008 | Berroth | 417/420 |

FOREIGN PATENT DOCUMENTS

| | | | |
|---|---|---|---|
| CN | 2685616 | Y | 3/2005 |
| CN | 101050769 | A | 10/2007 |
| CN | 101086262 | A | 12/2007 |
| JP | 07-208380 | A | 8/1995 |
| JP | 10-220386 | A | 8/1998 |
| JP | 2003-114052 | A | 4/2003 |
| JP | 2003-301788 | A | 10/2003 |
| JP | 2003-343492 | A | 12/2003 |
| JP | 2004-190562 | A | 7/2004 |
| JP | 2004-254415 | A | 9/2004 |
| JP | 2007-032405 | A | 2/2007 |
| JP | 2007032405 | A | 2/2007 |
| JP | 2008-008222 | A | 1/2008 |
| JP | 2008-215738 | A | 9/2008 |
| JP | 2008215738 | A | 9/2008 |

OTHER PUBLICATIONS

Office Action dated Jul. 6, 2012, issued in corresponding Chinese Patent Application No. 201010510881.3 and an English Translation thereof. (9 pages).

(Continued)

*Primary Examiner* — David Bryant
*Assistant Examiner* — Ryan J Walters
(74) *Attorney, Agent, or Firm* — Buchanan Ingersoll & Rooney PC

(57) ABSTRACT

A manufacturing method of a water circulating pump including a shaft, a pump part having a first casing in which a first concavity is formed for receiving one end portion of the shaft to restrain rotation of the shaft. A stator part has a second casing in which a second concavity is formed for receiving another end portion of the shaft to restrain rotation of the shaft and a stator for rotating a rotor by electromagnetic interaction. The method includes inserting the another end portion of the shaft into a position corresponding to the second concavity of a mold for molding the second casing, and molding the second casing by injecting a thermoplastic resin into the mold for molding the second casing into which the another end portion of the shaft has been inserted.

4 Claims, 4 Drawing Sheets

(56) References Cited

OTHER PUBLICATIONS

Office Action from Japanese Patent Office issued in corresponding Japanese Patent Application No. 2009-236317 dated Nov. 8, 2011, with an English translation thereof.

Notice of Rejection dated May 7, 2013 issued by the Japanese Patent Office in corresponding Japanese Patent Application No. 2011-270919.

* cited by examiner

WATER CIRCULATING PUMP, MANUFACTURING METHOD THEREOF, AND HEAT PUMP APPARATUS

TECHNICAL FIELD

The present invention relates to a water circulating pump and to a heat pump apparatus using this water circulating pump.

BACKGROUND ART

A pump to be used in a conventional heat pump apparatus employing water as a refrigerant includes a stator part, a rotor part, a pump part, and a shaft. The shaft is fixed, and the rotor part freely rotates around the shaft. The stator part includes an iron core formed of stacked electromagnetic steel sheets, a winding that is wound around a slot of the iron core via an insulator (insulating material), a circuit board connected with a lead line, and an approximately pot-shaped lower casing in a hollow cylindrical shape having a bottom part. The circuit board is positioned near the stator part at a side opposite from the pump part. The rotor part is housed in a hollow cylindrical interior of the approximately pot-shaped lower casing. At an approximately center portion of the bottom part of the lower casing, an axial hole is formed for fitting the shaft therein. The shaft is fitted into the axial hole in a non-rotating manner. To achieve this, the shaft to be fitted into the axial hole has a notched portion in its circular shape. The shaft is also shaped in the same fashion at another end thereof facing the pump part. The axial hole is also shaped in a nearly identical fashion to the shaft, with a diameter slightly larger than that of the shaft (as disclosed, for example, in Patent Documents 1 and 2).

CITATION LIST

Patent Literature

Patent Document 1: JP2003-114052
Patent Document 2: JP2008-215738

SUMMARY OF INVENTION

Technical Problem

In a water circulating pump to be used in a conventional heat pump apparatus, a shaft is merely inserted into an axial hole of a casing so that there is a gap between the shaft and the axial hole to achieve insertion. This causes deviation in the movement of the shaft when the rotor rotates, leading to problems such as increased vibration due to whirling of the rotor, uneven wear of a bearing, the rotor becoming locked on the shaft, and so on.

In consideration of whirling of the rotor, it is necessary to make the diameter of the rotor small enough not to touch the lower casing. This leads to an increased gap between a rotor magnet and the iron core (their mutual magnetic attraction decreases in proportion to the square of distance), thereby reducing pump efficiency, and so on.

When the casing is made of resin, because resin has a greater coefficient of linear expansion compared to a stator made of a molding resin or metal, there are disadvantages such as cracking of the resin due to stress from thermal cycles, water pressure and so on.

It is an object of the present invention to prevent breakage of a bearing or casing of a pump and to provide a highly efficient, long-life heat pump apparatus.

Solution to Problem

According to one aspect of the present invention, a water circulating pump comprises:

a shaft;

a pump part having a first casing in which a first concavity is formed for receiving a one end of the shaft to restrain rotation of the shaft;

a stator part having a second casing in which a second concavity is formed for receiving another end portion of the shaft to restrain rotation of the shaft and a stator for rotating a rotor by electromagnetic interaction; and a rotor part having a bearing mounted in a freely rotatable manner on the shaft and a magnet part mounted in a fixed manner on the bearing, the rotor part being the rotor that rotates by electromagnetic interaction with the stator of the stator part, wherein at least one gap of a gap between an outside surface of the one end portion of the shaft and an inside surface of the first concavity and a gap between an outside surface of the another end portion of the shaft and an inside surface of the second concavity is filled with a filler for filling the gap.

Advantageous Effects of Invention

The present invention can prevent breakage of a bearing or casing of a water circulating pump and provide a highly efficient, long-life heat pump apparatus.

DESCRIPTION OF EMBODIMENTS

Embodiment 1

Figure 1:
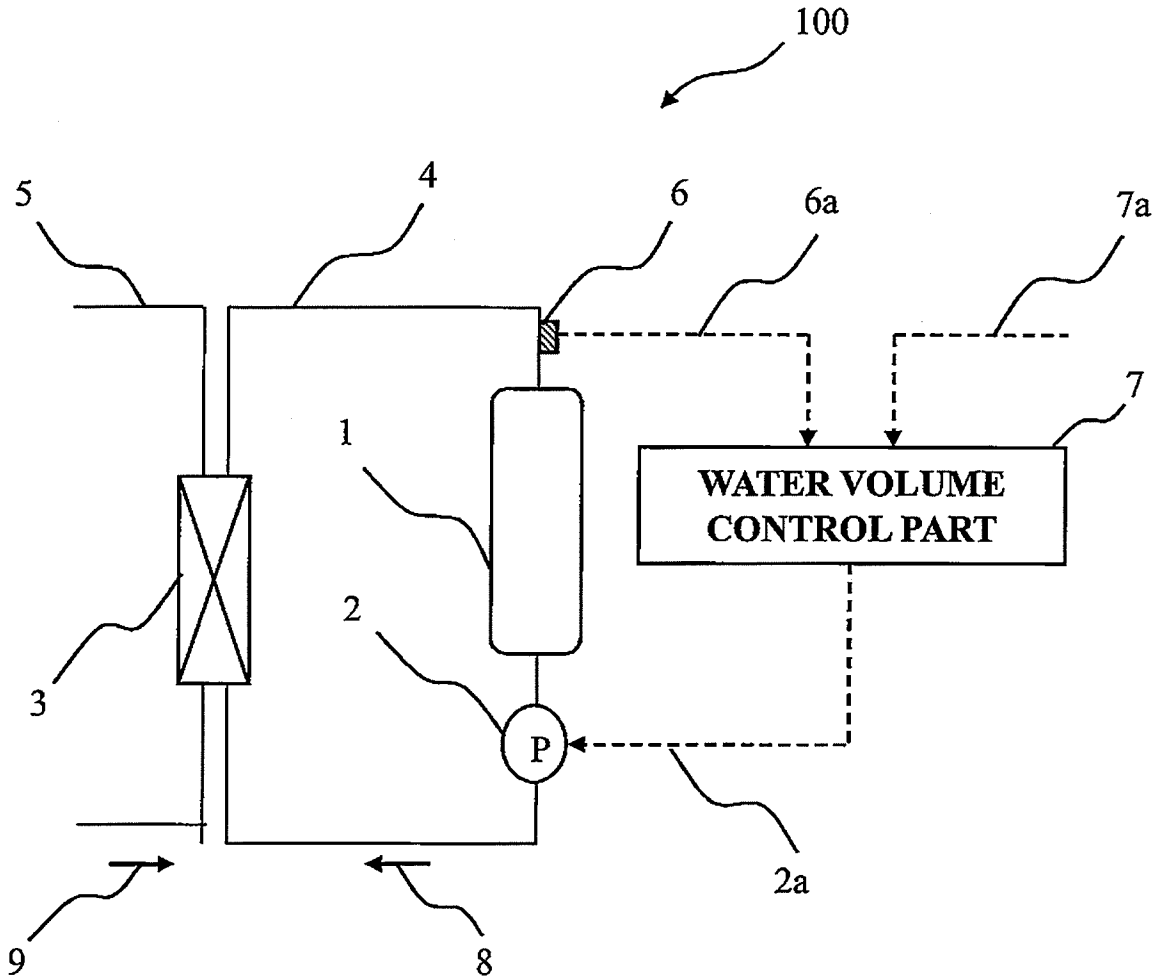
FIG. 1 shows a structure of a heat pump apparatus according to a first embodiment.
Figure 2:
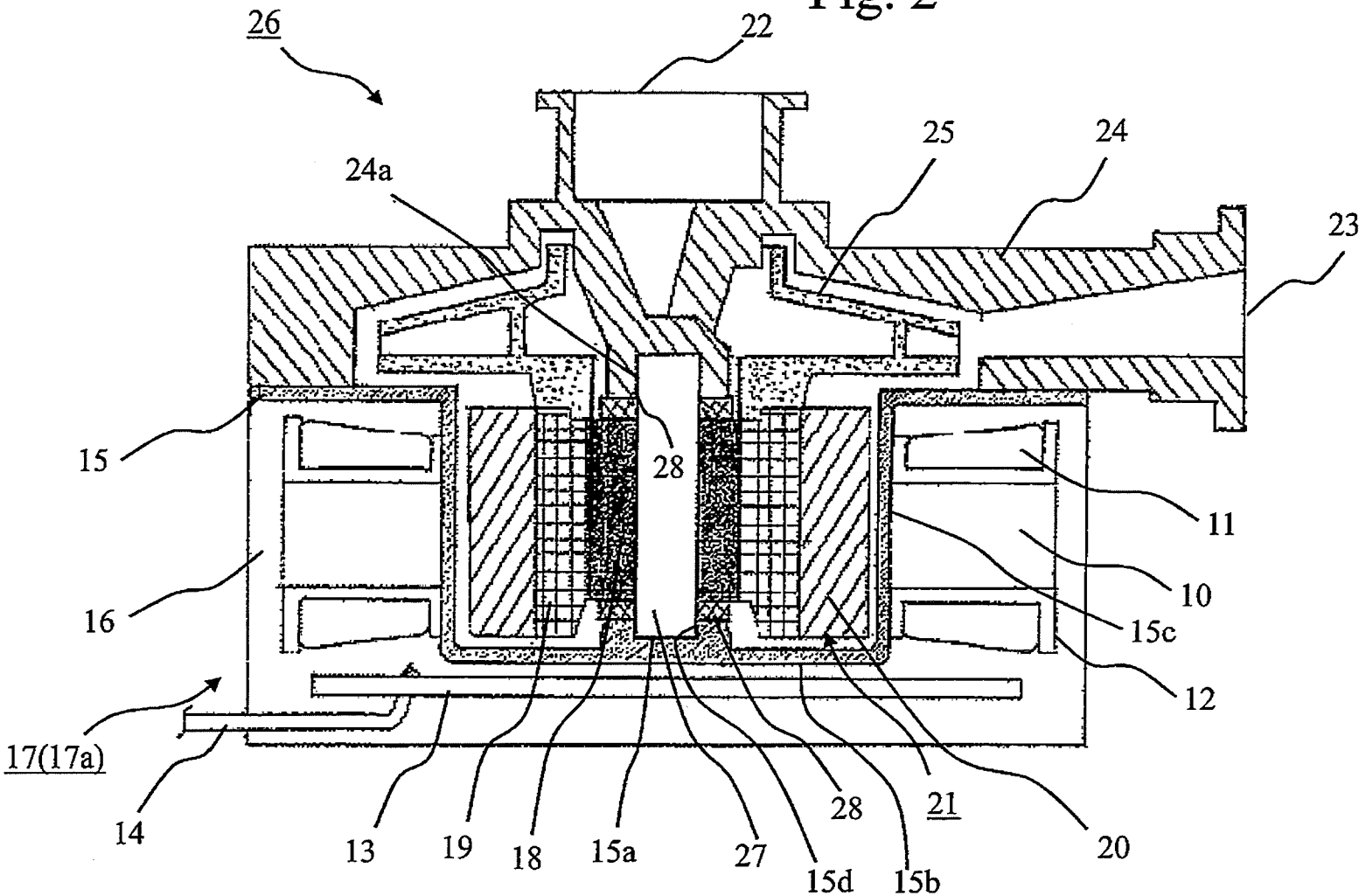
FIG. 2 shows a cross-sectional view of a pump 2 according to the first embodiment.
Figure 3:
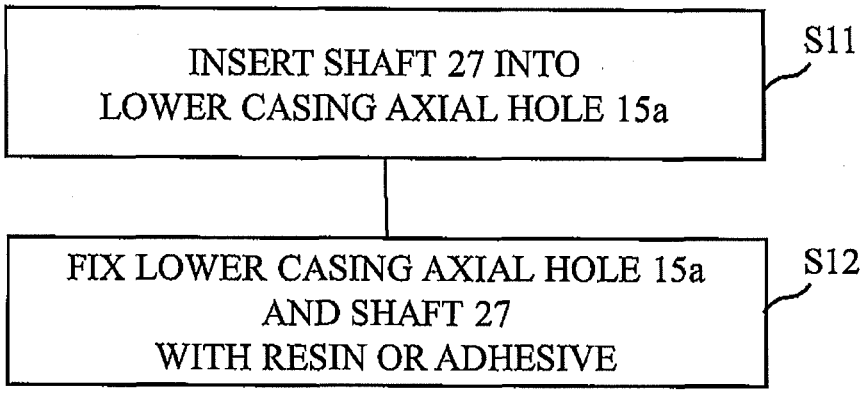
FIG. 3 is a flowchart showing main manufacturing steps of the pump 2 according to the first embodiment.

Referring to FIGS. 1 to 3, a first embodiment will be described. In the first embodiment, a pump 2 (water circulating pump) to be used in a heat pump apparatus 100 for circulating water will be described. The pump 2 according to the first embodiment is characterized in that a gap between a shaft on which a rotor part is attached and a fitting portion (a first concavity or a second concavity to be described later) of a casing into which the shaft is fitted is filled with a predetermined resin or a predetermined adhesive. By filling the gap with resin or the like, whirling of the rotor part associated with the rotation thereof can be reduced. The resin can be, for example, PPS (polyphenylene sulfide). The adhesive can be, for example, an epoxy or acrylic based adhesive.

FIG. 1 shows a structure of the heat pump apparatus 100. FIG. 2 is a cross-sectional view of the pump 2.

(Heat Pump Apparatus 100)

As shown in FIG. 1, the heat pump apparatus 100 comprises a compressor (not shown), a heat exchanger 3, and so on. The heat pump apparatus 100 comprises a refrigerant circuit 5 in which a refrigerant 9 flows, a tank 1, the pump 2, the heat exchanger 3, and so on. Further, the heat pump apparatus 100 includes a water circuit 4 in which water 8 flows; a water temperature sensing part 6 for sensing the water temperature of the water circuit 4; and a water volume control part 7, to which water temperature information 6*a* from the water temperature sensing part 6 and a water temperature setting command signal 7*a* are input, and which outputs a speed command signal 2*a* to the pump 2.

(Structure of the Pump 2)

Referring to FIG. 2, a structure of the pump 2 will be described. As shown in FIG. 2, the pump 2 includes a stator part 17, a rotor part 21, a pump part 26, and a shaft 27. The shaft 27 is fixed, and the rotor part 21 rotates around the shaft 27.

(Stator Part 17)

First, a structure of the stator part 17 will be described.

(1) The stator part 17 includes an iron core 10 which is approximately doughnut-shaped and formed of a plurality of stacked electromagnetic steel sheets punched out into a predetermined shape, a winding 11 to be inserted into a slot (not shown) of the iron core 10 via an insulator 12 (insulating material), a circuit board 13 connected with a lead line 14, and a lower casing 15 (second casing) which is approximately pot-shaped.

(2) The iron core 10 and the winding 11 to be inserted into the slot (not shown) of the iron core 10 via the insulator 12 (insulating material) constitute a stator 17*a* that generates a rotation moment for rotating the rotor part 21 by electromagnetic interaction with the rotor part 21.

(3) The circuit board 13 is positioned near one axial end portion (at an opposite side from the pump part 26) of the stator part 17.

(4) The rotor part 21 is housed in a space inside the approximately pot-shaped lower casing 15. As shown in FIG. 2, the lower casing 15 has a bottom part 15*b* and a hollow cylinder 15*c* rising from the bottom part 15*b*, and the shaft 27 and the rotor part 21 are housed in a space inside the hollow cylinder 15*c*. As will be described later, in the lower casing 15, the outer side of the hollow cylinder 15*c* forms an interface with a molding resin in which the stator 17*a* is sealed. At an approximately center portion of the bottom part 15*b* of the lower casing 15, a lower casing axial hole 15*a* is formed for inserting the shaft 27 therein. The lower casing axial hole 15*a* receives an end portion of the shaft 27 to restrain the rotation of the shaft 27. The shaft 27 is Inserted into the lower casing axial hole 15*a* in a non-rotating manner. To achieve this, the shaft 27 to be inserted into the lower casing axial hole 15*a* has a notched portion in its circular shape. The shaft 27 is also shaped in the same fashion at another end thereof facing the pump part 26. The lower casing axial hole 15*a* is also shaped in a nearly identical fashion to the shaft 27, with a diameter slightly larger than that of the shaft 27. An upper casing axial hole 24*a* is also shaped in a similar fashion as the lower casing axial hole 15*a*.

(5) A minute gap between the shaft 27 and the lower casing axial hole 15*a* is filled with a filler (filling material), such as a water-resistant and heat-resistant adhesive or resin, so that the shaft 27 is rigidly and fixedly secured in the lower casing axial hole 15*a*.

(6) By using a molding resin 16, the stator part 17 is molded integrally with the circuit board 13 and the stator 17*a* having the iron core 10 around which the winding 11 is wound. The molding resin 16 forms an outside surface of the stator part 17. A bearing 18, a wheel 19, and a magnet part 20 together constitute the rotor part 21.

(Rotor Part 21)

The rotor part 21 includes the bearing 18 at an approximately center portion thereof. The rotor part 21 (bearing 18) is mounted in a freely rotatable manner on the shaft 27. The wheel 19 made of resin is positioned outside of the bearing 18. The magnet part 20 is positioned outside of the wheel 19. The magnet part 20 is made from a mixture of magnetic powder (such as ferrite) and resin, which is then magnetized.

(Brushless DC Motor)

The stator part 17 and the rotor part 21 constitute, for example, a brushless DC motor.

(Pump Part 26)

The pump part 26 includes an impeller 25 and an upper casing 24 (first easing) having a water inlet 22 and a discharge outlet 23. In the upper casing 24, the upper casing axial hole 24*a* (first concavity) is formed for receiving an end portion of the shaft 27 to restrain the rotation of the shaft 27. The impeller 25 is fixedly mounted on the rotor part 21, and rotates with the rotor part 21. The water circuit 4 is connected with the water inlet 22 and the discharge outlet 23.

(Example of a Manufacturing Method of the Pump 2)

Referring to FIG. 3, an example of an assembly process of the pump 2 according to the first embodiment will be described.

(1) In S11, the end portion of the shaft 27 is inserted into the lower casing axial hole 15*a* of the lower casing 15. This secures the shaft 27 to the lower casing 15. Then, the bearing 18 of the rotor part 21 is fitted on the shaft 27, and the washer 28 is further fitted on the bearing 18, so that the shaft 27 extends through a hole of the washer 28. A surface of the washer 28 comes into contact with a surface of the bearing 18, thus forming a thrust bearing. Then, the end portion facing the pump part 26 of the shaft 27 extending through the washer 28 is inserted into the upper casing axial hole 24*a*, so as to constitute the pump part 26 enclosed in the upper and lower casings. The rotor part 21 with the impeller 25 fixed thereon is freely rotatable around the shaft 27.

(2) In S12, in the pump part 2, at least one of a gap between the outside surface of the end portion facing the upper casing 24 of the shaft 27 and the inside surface of the upper casing axial hole 24*a* and a gap between the outside surface of the end portion of the shaft 27 and the inside surface of the lower casing axial hole 15*a* is filled with a filler (a predetermined resin or a predetermined adhesive) for filling the gap.

The space enclosed by the lower casing 15 and the upper casing 24 is filled with the water (hot water) of the water circuit 4. Thus, the rotor part 21, the impeller 25, the shaft 27, and the washer 28 come into contact with the water (hot water) flowing in the pump 2. The pump 2 is a canned pump in which the water flowing in the pump 2 comes into contact with the rotor part 21 of the brushless DC motor.

The pump 2 according to the first embodiment is configured such that at least one of the gap between the outside surface of the end portion facing the upper casing 24 of the shaft 27 and the inside surface of the upper casing axial hole 24*a* and the gap between the outside surface of the end portion of the shaft 27 and the inside surface of the lower casing axial hole 15*a* is filled with a filler (a predetermined resin or a predetermined adhesive) for filling the gap. This eliminates rattling of the shaft 27 in the lower casing 15, and can also reduce the gap between the rotor part 21 and the iron core 10. Therefore, uneven wear and breakage of the bearing 18 can be prevented, and pump efficiency can also be improved.

Embodiment 2

Figure 4:
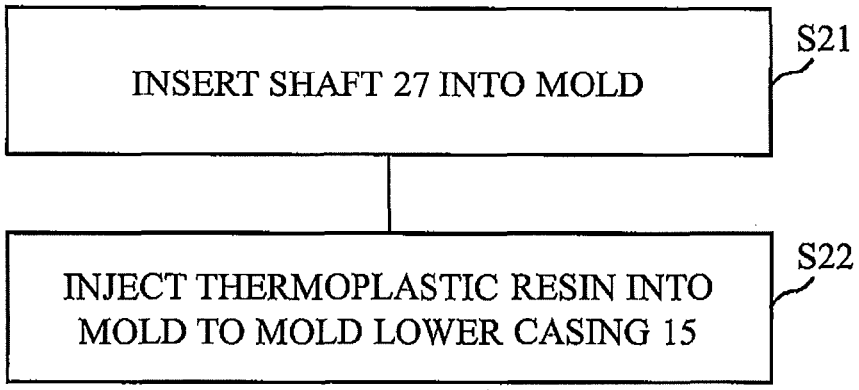
FIG. 4 is a flowchart showing main manufacturing steps of the pump 2 according to a second embodiment.

Referring now to FIGS. 2 and 4, a second embodiment will be described. The second embodiment concerns a manufacturing method of the pump 2 of FIG. 2 in which at least the lower casing 15, between the upper and lower casings, is molded of a thermoplastic resin. In the manufacturing method of the pump 2 according to the second embodiment, the shaft 27 is inserted into a mold for molding the casing and a thermoplastic resin is injection-molded, so as to mold the lower casing 15 with the shaft 27 fitted therein. The thermoplastic resin can be PPS or SPS (syndiotactic polystyrene).

Referring to FIG. 4, a case of molding the lower casing 15 out of a thermoplastic resin will be described.

(S21)

S21 is a step of inserting the shaft 27 (first insertion step). A mold for molding the lower casing 15 to be used in this step allows an end portion of the shaft 27 to be inserted therein into a position corresponding to the lower casing axial hole 15*a* (second concavity). In S21, the end portion of the shaft 27 is inserted into the mold for molding the lower casing 15 into the position corresponding to the lower casing axial hole 15*a*.

(S22)

S 22 is a step of injecting a thermoplastic resin. In S22, a thermoplastic resin is injected into the mold for molding the lower casing 15 with the end portion of the shaft 27 inserted therein. In this way, the lower casing 15 is molded so that the outside surface of the end portion of the shaft 27 is integrated, without any gap, with the inside surface 15*d* of the lower casing axial hole 15*a* for inserting the shaft 27.

As described above, the lower casing 15 is molded integrally with the shaft 27 by inserting the shaft 27 into the mold for molding the lower casing. This eliminates rattling of the shaft 27 in the lower casing axial hole 15*a*, prevents uneven wear and breakage of the bearing 18, and improves efficiency and lifetime of the pump 2. Further, compared to the first embodiment, the fixing strength between the shaft 27 and the lower casing 15 (lower casing axial hole 15*a*) can be readily achieved, and the process can be simplified so that productivity can be improved.

Embodiment 3

Figure 5:
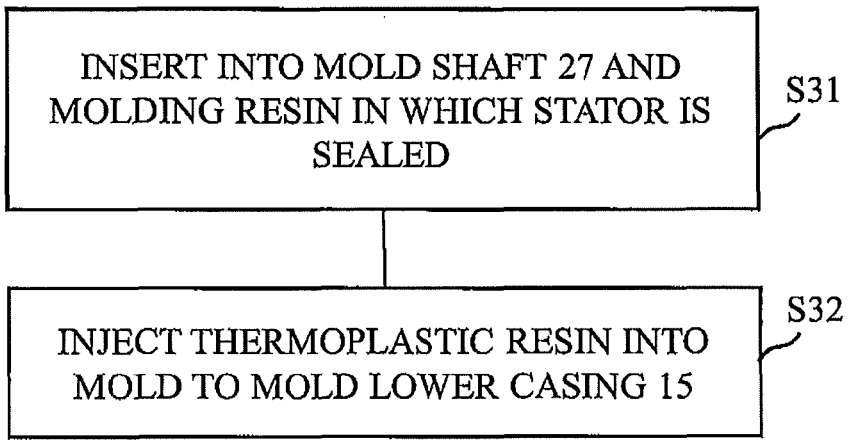
FIG. 5 is a flowchart showing main manufacturing steps of the pump 2 according to a third embodiment.

Referring now to FIGS. 2 and 5, a third embodiment will be described. The third embodiment concerns a manufacturing method of the pump 2. In this method, the shaft 27 and a molding resin in which the stator is sealed are inserted into a mold. Then, a thermoplastic resin is injected into the mold, so as to mold the lower casing 15.

Compared to the mold of the second embodiment, the mold for molding the lower casing 15 of the third embodiment further allows insertion of the molding resin 16 in which the stator 17*a* is sealed.

Referring to FIG. 5, the manufacturing method of the pump 2 according to the third embodiment will be described.

(S31)

S31 is an insertion step. In S31, the shaft 27 and "the molding resin 16 in which the stator 17*a* is sealed" are inserted into the mold for molding the lower casing 15.

(S32)

S32 is a step of injecting a thermoplastic resin. In S32, the lower casing 15 is molded by injecting a thermoplastic resin into the mold in which the end portion of the shaft 27 and "the hardened molding resin 16 in which the stator 17*a* is sealed" have been inserted.

As described above, the lower casing 15 is molded integrally with the end portion of the shaft 27 and the molding resin 16 by inserting the shaft 27 and "the stator 17*a* molded of the molding resin 16" into the mold and by injecting a thermoplastic resin into the mold. This eliminates rattling of the shaft 27 in the lower casing axial hole 15*a*, prevents uneven wear and breakage of the bearing 18, and improves efficiency and lifetime of the pump 2. Further, the lower casing 15 that is molded integrally with the stator 17*a* sealed in the molding resin 16, as shown in FIG. 2, contacts the inside surface of the molding resin in which the stator 17*a* is sealed with no gap therebetween. This provides advantages such as "improved strength" and "reduced risk of breakage of the pump part 26 due to water pressure", compared to when the lower casing 15 molded solely of resin is inserted. Further, the casing can be made thinner while maintaining strength equivalent to when it is molded solely of resin. Therefore, the gap between the rotor part 21 and the iron core 10 can be reduced, resulting in improved efficiency.

Embodiment 4

Next, a fourth embodiment will be described. In the fourth embodiment, at least the lower casing 15, between the upper casing 24 and the lower casing 15, is molded of a non-magnetic metal.

That is, in FIG. 2, at least the lower casing 15, between the upper and lower casings, is formed by plastic working out of a non-magnetic metal that has a higher strength than resin. This allows the casing to be made thinner. Using a non-magnetic metal allows the casing to be made thinner compared to resin. Thus, the gap between the rotor part 21 and the iron core 10 can be reduced, resulting in improved pump efficiency. Further, using a non-magnetic metal for the lower casing 15 produces no harmful effects, such as reduced magnetic attraction between the rotor part 21 and the iron core 10. The non-magnetic metal can be austenite stainless steel, aluminum, copper, and so on. Further, metal has a higher thermal conductivity than resin and therefore has an excellent cooling effect, so that it can prevent breakage of the bearing 18 due to temperature rise.

Embodiment 5

Figure 6:
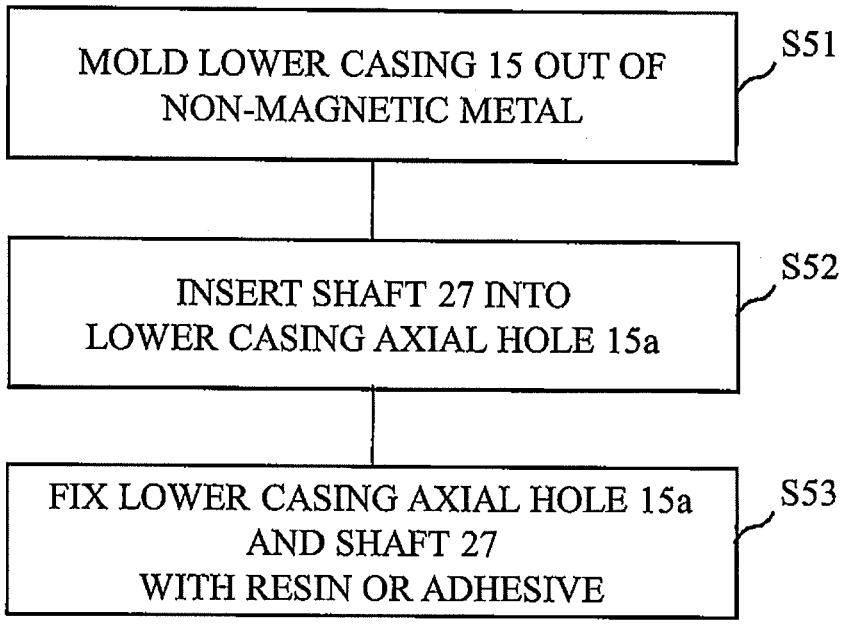
FIG. 6 is a flowchart showing main manufacturing steps of the pump 2 according to a fifth embodiment.

Referring now to FIGS. 2 and 6, a fifth embodiment will be described. The fifth embodiment is similar to the first embodiment except that a non-magnetic metal is used for the lower casing 15. This will be described hereafter with reference to FIG. 6.

In S51, the lower casing 15 is molded of a non-magnetic metal. That is, the lower casing 15 is formed by plastic working by using a non-magnetic metal as its material. In S52, the shaft 27 is inserted into the lower casing axial hole 15*a*. In S53, the gap between the shaft 27 and the lower casing axial hole 15*a* is injection-molded with a thermoplastic resin, or is filled with an adhesive, so as to mold the shaft 27 and the lower casing axial hole 15*a* integrally with no gap therebetween.

The above steps can eliminate rattling of the shaft 27 in the lower casing axial hole 15*a*, prevent uneven wear and breakage of the bearing 18, and improve efficiency and lifetime of the pump 2. Further, when a thermoplastic resin is injection-molded, there is an advantage that the fixing strength between the shaft 27 and the lower casing 15 can be more readily achieved compared to adhesion. Further, aluminum is used as a material for the lower casing 15, and the alumite treatment is applied to the surface around the lower casing axial hole 15*a* to form micropores. Then, the shaft 27 is inserted into the lower casing axial hole 15*a*, and a molten resin is injection-molded into this portion. At this time, due to an anchor effect caused by the molten resin entering the micropores, joining strength can be further improved. Thus, the joining strength between the shaft 27 and the lower casing 15 is further increased, allowing use, for example, in a high-output pump in which the rotor part 21 has a large inertia mass.

Embodiment 6

Figure 7:
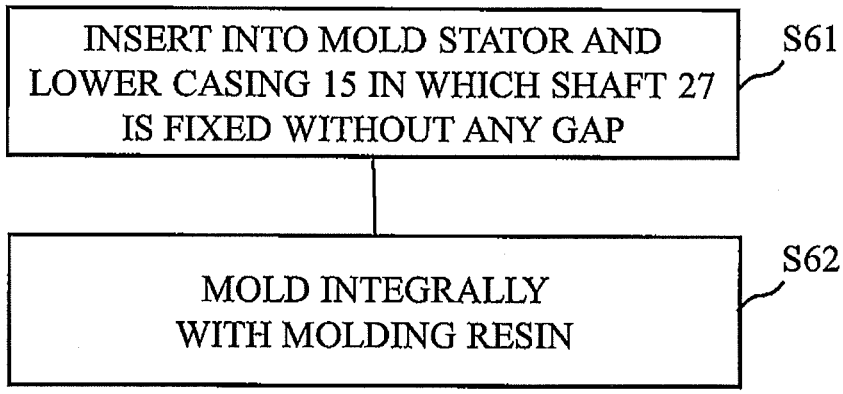
FIG. 7 is a flowchart showing main manufacturing steps of the pump 2 according to a sixth embodiment.

Next, a manufacturing method of the pump 2 according to a sixth embodiment will be described. FIG. 7 is a flowchart illustrating main steps of this manufacturing method.

(S61)

S61 is an insertion step (second insertion step). In S61, the stator 17*a* and the lower casing 15 in which the outside surface of the shaft 27 is integrated with the inside surface of the lower casing axial hole 15*a* with no gap therebetween are inserted into a mold.

(S62)

S62 is a molding step. In S62, by using the molding resin, the stator 17*a* inserted into the mold is sealed in the molding resin, and an interface is formed between the molding resin and the outer side of the hollow cylinder 15*c* of the lower casing 15 inserted into the mold.

According to the manufacturing method shown in FIG. 7, the adhesion between the lower casing 15 and "the molding resin 16 in which the stator 17*a* is sealed" is improved. This can prevent breakage of the lower casing 15 due to stress from thermal cycles and so on, or due to water pressure.

By using a PPS (polyphenylene sulfide) containing an elastomer as the thermoplastic resin according to the first to sixth embodiments described above, toughness can be increased, breakage of the resin due to thermal cycles or water pressure can be prevented, and lifetime of the pump 2 can be increased. In the first to sixth embodiments described above, the molding resin can be an unsaturated polyester or an epoxy resin.

While the foregoing embodiments provide examples of the pump 2 to be used for conveying and circulating water in the heat pump apparatus 100, it is apparent that these embodiments may also be used for a household pump and the like.

REFERENCE SIGNS LIST

1: tank, 2: pump, 2*a*: speed command signal, 3: heat exchanger, 4: water circuit, 5: refrigerant circuit, 6: water temperature sensing part, 6*a*: water temperature information, 7: water volume control part, 7*a*: water temperature setting command signal, 8: water, 9: refrigerant, 10: iron core, 11: winding, 12: insulator, 13: circuit board, 14: lead line, 15: lower casing, 15*a*: lower casing axial hole, 15*b*: bottom part, 15*c*: hollow cylinder, 15*d*: internal peripheral surface, 16: molding resin, 17: stator part, 17*a*: stator, 18: bearing, 19: wheel, 20: magnet part, 21: rotor part, 22: water inlet, 23: discharge outlet, 24: upper casing, 24*a*: upper casing axial hole, 25: impeller, 26: pump part, 27: shaft, 28: washer, 100: heat pump apparatus

The invention claimed is:

1. A manufacturing method of a water circulating pump, the water circulating pump including:

a shaft;

a pump part having a first casing in which a first concavity is formed for receiving a one end portion of the shaft to restrain rotation of the shaft;

a stator part having a second casing in which a second concavity is formed for receiving another end portion of the shaft to restrain rotation of the shaft and a stator for rotating a rotor by electromagnetic interaction; and a rotor part having a bearing mounted in a freely rotatable manner on the shaft and a magnet part mounted in a fixed manner on the bearing, and the rotor that rotates by electromagnetic interaction with the stator of the stator part, the manufacturing method of the water circulating pump comprising:

inserting the another end portion of the shaft into a position corresponding to the second concavity of a mold for molding the second casing, the mold allowing the another end portion of the shaft to be inserted into the position corresponding to the second concavity; and molding the second casing by injecting a thermoplastic resin into the mold for molding the second casing into which the another end portion of the shaft has been inserted, so that an outside surface of the another end portion of the shaft is integrated with an inside surface of the second concavity with no gap therebetween;

wherein the second casing is shaped to have a bottom part and a hollow cylinder rising from the bottom part, the shaft and the rotor part are housed in a space inside the hollow cylinder, and an outer side of the hollow cylinder forms an interface with a molding resin in which the stator is sealed;

wherein the mold for molding the second casing allows insertion of the molding resin in which the stator is sealed;

wherein, inserting the another end portion of the shaft, further comprises inserting the molding resin in which the stator is sealed into the mold for molding the second casing; and wherein, molding the second casing, further comprises injecting the thermoplastic resin into the mold for molding the second casing into which the another end portion of the shaft and the molding resin in which the stator is sealed have been inserted.

2. The manufacturing method of a water circulating pump of claim 1, wherein the thermoplastic resin is a PPS (polyphenylene sulfide) containing an elastomer.

3. A manufacturing method of a water circulating pump, the water circulating pump including:

a shaft;

a pump part having a first casing in which a first concavity is formed for receiving a one end portion of the shaft to restrain rotation of the shaft;

a stator part having a second casing in which a second concavity is formed for receiving another end portion of the shaft to restrain rotation of the shaft and a stator for rotating a rotor by electromagnetic interaction; and a rotor part having a bearing mounted in a freely rotatable manner on the shaft and a magnet part mounted in a fixed manner on the bearing, and the rotor that rotates by electromagnetic interaction with the stator of the stator part, the manufacturing method of the water circulating pump comprising:

inserting the another end portion of the shaft into a position corresponding to the second concavity of a mold for molding the second casing, the mold allowing the another end portion of the shaft to be inserted into the position corresponding to the second concavity; and molding the second casing by injecting a thermoplastic resin into the mold for molding the second casing into which the another end portion of the shaft has been inserted, so that an outside surface of the another end portion of the shaft is integrated with an inside surface of the second concavity with no gap therebetween;

wherein the second casing is shaped to have a bottom part and a hollow cylinder rising from the bottom part, the shaft and the rotor part are housed in a space inside the hollow cylinder, and an outer side of the hollow cylinder forms an interface with a molding resin in which the stator is sealed; and wherein the manufacturing method of a water circulating pump further comprises:

inserting, into a mold, the stator and the second casing formed by integrating an outside surface of the another end portion of the shaft and an inside surface of the second concavity with no gap therebetween; and by using the molding resin, sealing within the molding resin the stator inserted into the mold, and forming an interface between the molding resin and an outer side of the hollow cylinder of the second casing inserted into the mold.

4. The manufacturing method of a water circulating pump of claim 3, wherein the thermoplastic resin is a PPS (polyphenylene sulfide) containing an elastomer.

* * * * *